US008783201B2

(12) United States Patent
Copenhaver

(10) Patent No.: US 8,783,201 B2
(45) Date of Patent: Jul. 22, 2014

(54) RETRIEVABLE ANCHOR SYSTEM

(76) Inventor: Alan R. Copenhaver, Hinton, IA (US)

( * ) Notice: Subject to any disclaimer, the term of this patent is extended or adjusted under 35 U.S.C. 154(b) by 140 days.

(21) Appl. No.: 13/303,828

(22) Filed: Nov. 23, 2011

(65) Prior Publication Data

US 2013/0125804 A1 May 23, 2013

(51) Int. Cl.
*B63B 21/46* (2006.01)

(52) U.S. Cl.
USPC ..... 114/299

(58) Field of Classification Search
CPC ..... B63B 21/46
USPC ..... 114/294, 297, 298, 299, 310
See application file for complete search history.

(56) References Cited

U.S. PATENT DOCUMENTS

| | | | | | |
|---|---|---|---|---|---|
| 5,547 | A | * | 5/1848 | Kentish | 114/310 |
| 2,764,116 | A | | 9/1956 | Brewer | |
| 2,816,522 | A | | 12/1957 | Root | |
| 3,150,629 | A | | 9/1964 | Fields | |
| 3,841,255 | A | * | 10/1974 | Mansfield | 114/299 |
| 4,721,054 | A | | 1/1988 | Kobayashi | |
| 4,836,126 | A | | 6/1989 | Kobayashi | |
| 5,074,235 | A | | 12/1991 | Kobayashi | |
| 5,784,981 | A | * | 7/1998 | Graham, Sr. | 114/299 |
| 6,009,826 | A | | 1/2000 | Nole | |
| 6,311,636 | B1 | * | 11/2001 | Degenkamp | 114/297 |
| 7,870,831 | B2 | | 1/2011 | Richert | |
| 7,886,681 | B2 | * | 2/2011 | Weinstein et al. | 114/299 |

OTHER PUBLICATIONS

River Grapple Anchors, web page, www.rivergrapple.com, download date Nov. 23, 2011.

* cited by examiner

*Primary Examiner* — Stephen Avila
*Assistant Examiner* — Andrew Polay
(74) *Attorney, Agent, or Firm* — Jeffrey A. Proehl; Woods, Fuller, Shultz & Smith, P.C.

(57) ABSTRACT

A retrievable anchor system may comprise an anchor having a central shank with a top and bottom end, an elongate flexible member having a base end substantially permanently fixed to the bottom end of the central shank. The system may further comprise a dual attachment assembly releasably attaching a location on the flexible member to a location on the central shank located toward the top of the anchor, with the location on the flexible member being separated from the base end of the member. The dual attachment assembly may comprise a primary attachment structure forming a directional attachment between the flexible member and the central shank, and a secondary attachment structure forming a frangible attachment of the flexible member to the central shank.

18 Claims, 3 Drawing Sheets

RETRIEVABLE ANCHOR SYSTEM

BACKGROUND

Field

The present disclosure relates to anchors and more particularly pertains to a new retrievable anchor system with an uncomplicated structure that permits simple retrieval of an anchor stuck in an obstruction while facilitating easy resetting of the device.

SUMMARY

In one aspect, the present disclosure relates to a retrievable anchor system comprising an anchor having a top and a bottom, with the anchor comprising an elongated central shank having a top end and a bottom end. The system may also comprise an elongate flexible member for suspending the anchor from a boat, with the flexible member having a base end and a securing end. The base end may be substantially permanently fixed to the bottom end of the central shank of the anchor. The system may further comprise a dual attachment assembly releasably attaching a location on the flexible member to a location on the central shank located toward the top of the anchor, with the location on the flexible member being separated from the base end of the flexible member. The dual attachment assembly may comprise a primary attachment structure forming a directional attachment between the flexible member and the central shank, and a secondary attachment structure forming a frangible attachment of the flexible member to the central shank.

In another aspect, the present disclosure relates to a retrievable anchor system that may comprise an anchor having a top and a bottom, with the anchor comprising an elongated central shank having a top end and a bottom end. The system may comprise a chain for suspending the anchor from a boat, the chain having a base end and a securing end, the base end being substantially permanently fixed to the bottom end of the central shank of the anchor. The system may also comprise a dual attachment assembly releasably attaching a location on the chain to a location on the central shank located toward the top of the anchor, with the location on the chain being separated from the base end of the chain. The dual attachment assembly may comprise a primary attachment structure forming a directional attachment between the chain and the central shank, with the primary attachment structure being configured to maintain attachment of the chain to the central shank when the chain is pulled in an upward direction with respect to the central shank. The primary attachment structure may also be configured to release attachment of the chain to the central shank when the chain is pulled in a downward direction with respect to the central shank. The dual attachment structure may also comprise a secondary attachment structure forming a frangible attachment of the chain to the central shank, with the secondary attachment structure comprising a loop of frangible material extending about a portion of the chain and about the central shank of the anchor.

In a further aspect, the present disclosure relates to a dual attachment assembly for an anchor having an elongated central shank with a top end and a bottom end and a chain with a base end substantially permanently fixed to the bottom end of the central shank. The assembly may comprise a primary attachment structure forming a directional attachment between the chain and the central shank at a first location on the central shank located toward the top of the anchor and at a first location on the chain separated from the base end of the chain. The primary attachment structure may be configured to maintain attachment of the location on the chain to the central shank when the chain is pulled in an upward direction with respect to the central shank. The primary attachment structure may be configured to release attachment of the location on the chain to the central shank when the chain is pulled in a downward direction with respect to the central shank. The assembly may also comprise a secondary attachment structure forming a frangible attachment of the chain to the central shank adjacent at a second location on the central shank located toward the top of the anchor and at a second location on the chain separated from the base end of the chain. The secondary attachment structure may comprise a loop of frangible material extending about a portion of the chain and about the central shank of the anchor.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
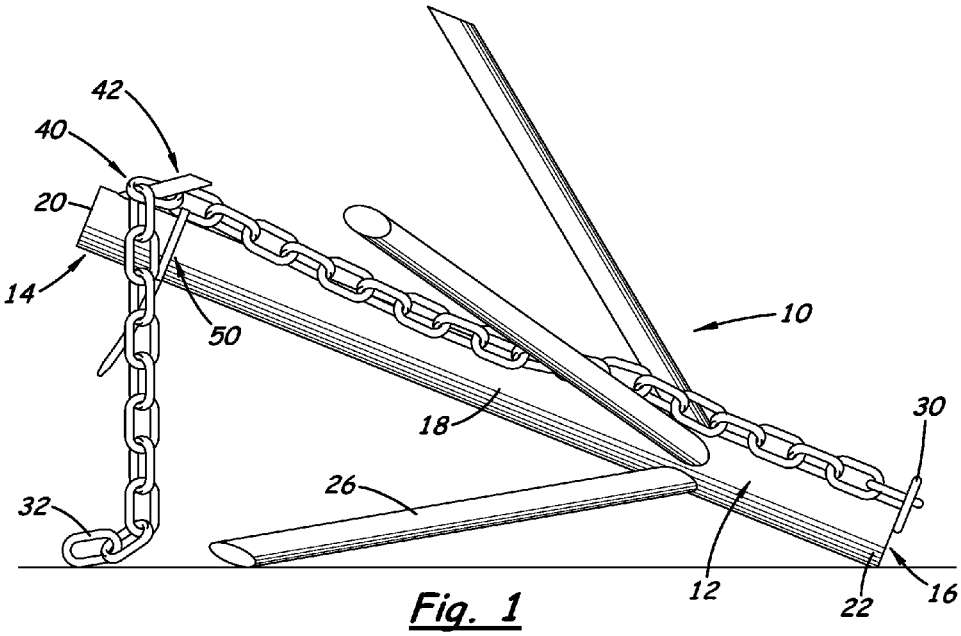
FIG. 1 is a schematic perspective view of a new retrievable anchor system according to the present disclosure.
Figure 2:
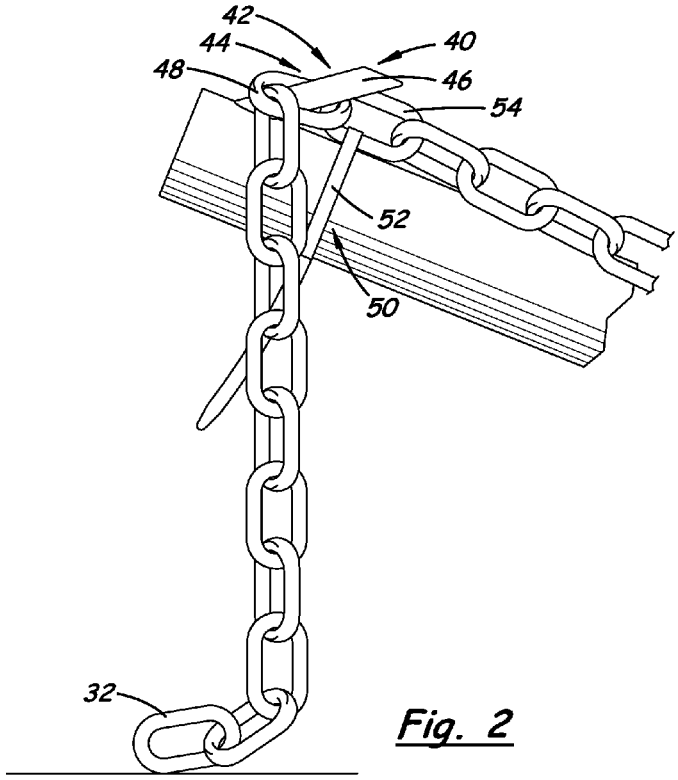
FIG. 2 is a schematic side view of an upper portion of the retrievable anchor system, according to an illustrative embodiment.
Figure 3A:
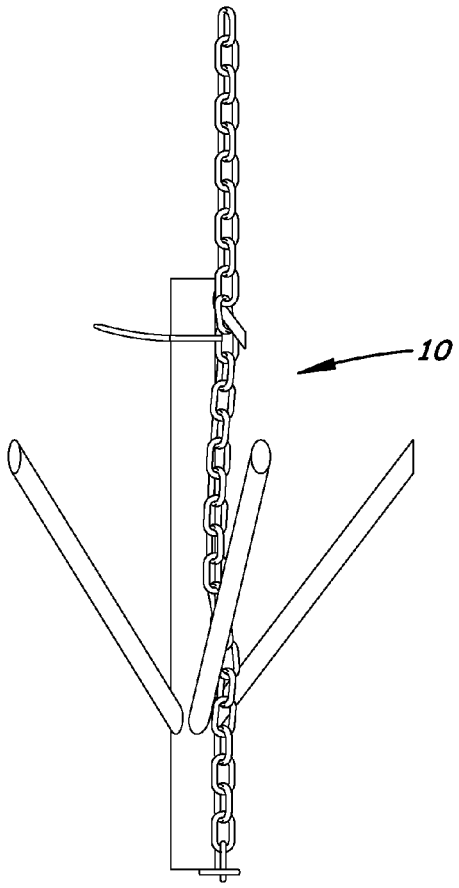
FIG. 3A is a schematic side view of the anchor system being lowered in a body of water to a bed or floor of the body of water.
Figure 3B:
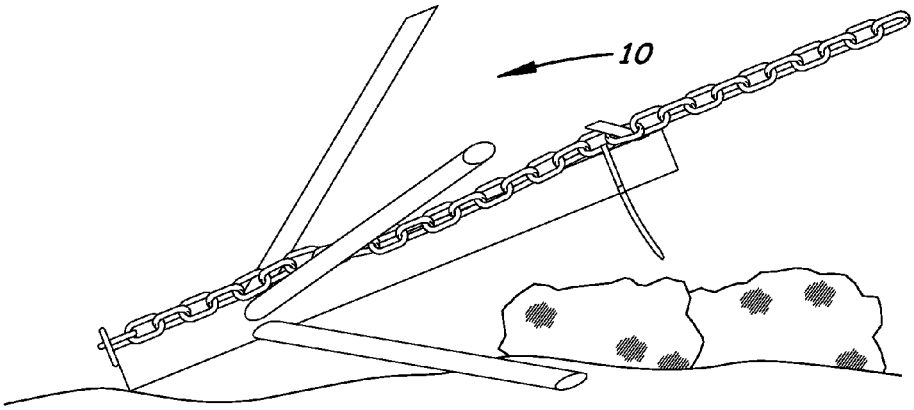
FIG. 3B is a schematic side view of the anchor system resting on the floor of the body of water and lodged on an obstruction such as a large rock which resists normal retrieval of the anchor.
Figure 3C:
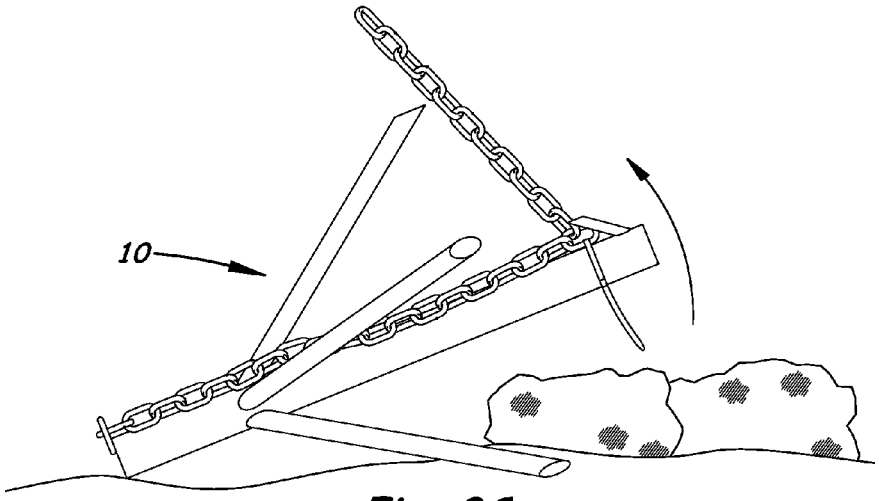
FIG. 3C is a schematic side view of the anchor system lodged on an obstruction with the chain being pulled in a direction generally opposite to the top of the anchor with the chain being released from the hook structure of the primary attachment structure.
Figure 3D:
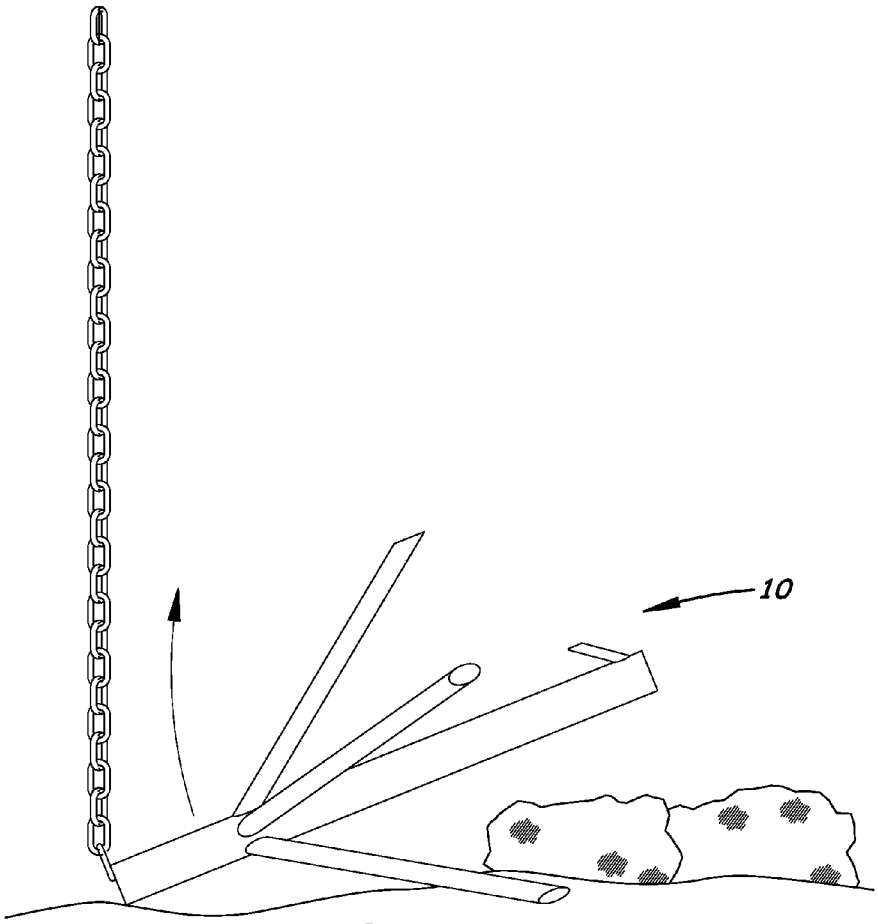
FIG. 3D is a schematic side view of the anchor system lodged on an obstruction after the frangible loop has been broken to release the chain from the secondary attachment structure, allowing the anchor to be pulled upwardly from the bottom of the anchor.

With reference now to the drawings, and in particular to FIGS. 1 through 3 thereof, a new retrievable anchor system embodying the principles and concepts of the disclosed subject matter will be described.

In some aspects, the disclosure relates to a retrievable anchor system 10, and in other aspects, the disclosure relates to a dual attachment assembly 40 for use on an anchor 12. The system 10 may include an anchor 12 having a top 14 and a bottom 16. In general, the top 14 of the anchor is oriented above or at a higher vertical level than the bottom 16 of the anchor when the anchor 12 is rested on a surface, such as the surface of the lake or sea bed under a body of water. The anchor may be of many different configurations, and for the most part the particular type or configuration of the anchor is not critical to the usefulness of the system. One structure that is significant to the suitability of a style of the anchor is the presence of an elongated central shank 18 that in many embodiments is elongated and relatively thin in character and extends from a location proximate to the top 14 to the bottom 16 of the anchor. The central shaft 18 may have a top end 20 that is proximate to the top 14 of the anchor and a bottom end 22 that is proximate to the bottom 16 of the anchor, although an exact correspondence between these locations is not required.

The balance of the structure of the anchor is not as significant to the usefulness of the system as the central shank 18. In the illustrative embodiments of the anchor 12, a plurality of fluke elements 26 are mounted on the central shank 18 and extend outwardly from the shank. Each of the fluke elements 26 may radiate outwardly from the central shank 18. The fluke elements 26 may be mounted on the central shank 18 toward the bottom end 22 and may extend generally toward the top end 20 as the elements 26 extend outwardly from the central shank. In some embodiments, the free end or tips of the fluke elements may have a tapered or diminished thickness to facilitate penetration into the bed of the body of water.

The system 10 may also comprise an elongate flexible member 28 for suspending the anchor 12 from a watercraft such as a boat. Sometimes referred to a as a "rode" in anchor parlance, the elongate flexible member 28 may comprise a chain formed of a plurality of links that are linked together. Although a chain is employed in many of the most preferred embodiments, the flexible member could be formed of another type of structure, such as a rope or a cable. The elongate flexible member 28 has a base end 30 and a securing end 32. The base end 30 may be relatively permanently attached or fixed to the bottom end 22 of the central shank of the anchor.

Significantly, the dual attachment assembly 40 of the system 10 facilitates the release of the anchor from an underwater obstruction when the anchor becomes lodged or tangled in something on the lake or sea bed. The dual attachment assembly 40 allows the anchor to be inverted or turned upside down so that the structures of the anchor that are designed to dig into the lake or sea bed, such as the fluke elements 26, are changed in orientation when a pulling force is applied to the flexible member in particular orientations and magnitudes. The dual attachment assembly 40 may releasably attach a portion of the elongate flexible member 28 to a location on the central shank 18 that is generally located toward the top 14 of the anchor, and toward the top end 20 of the central shank 18. The portion of the flexible member 28 may be spaced or separated from the base end 30 of the elongate member by a distance, so that the portion is located between the base end 30 and the securing end 32 of the flexible member.

The dual attachment assembly 40 may include a primary attachment structure 42 that forms a directional attachment between the elongate flexible member 28 and the central shank 18, or a attachment that is effective in at least one direction and is ineffective in t least one direction. The primary attachment structure 42 attaches the flexible member 28 at a location on that is spaced or separated from the base end 30 to the central shank at a location on the shank that is located toward the top end of the shank. The primary attachment structure 42 may maintain the attachment of the flexible member 28 to the central shank 18 when the flexible member is pulled in an upward direction with respect to the central shank, or in the direction toward the top end of the shank. The primary attachment structure 42 may release attachment of the flexible member 28 to the central shank 18 when the flexible member 28 is pulled in a downward direction with respect to the central shank, or in the direction toward the bottom end 22.

In some embodiments, the primary attachment structure 42 comprises a hook element 44 mounted on the central shank 18 at a location towards the top end 20. The hook element 44 may be permanently mounted on the central shank, and may be configured to engage the location on the elongate flexible member of the primary attachment. The hook element 44 may be configured to be inserted into one of the links of the chain of the flexible member 28. The hook element 44 may open in a direction toward the bottom end 22 of the central shank 18, and may be configured so that the opening of the hook opens wider towards the bottom end. The hook element 44 may be formed by a finger 46 attached to the central shank and extending downwardly and outwardly from the shank. The tip of the finger 46 may be inserted into the opening of one of the chain links 48 when the flexible member 28 comprises a chain. The finger 46 may have an axis, and in some embodiments the axis is oriented at an angle of approximately 30 degrees to approximately 60 degrees with respect to an axis of the central shank. In some of the most preferred embodiments, the axis may be oriented at approximately a 45 degree angle with respect to an axis of the central shank.

The nature of the attachment created by the primary attachment structure 42 is thus directional in that the structure 42 resists detachment when the movement of (or force is applied to) the flexible member is in an upward direction toward the top 14 of the anchor (such as when the anchor is in a normal orientation on the lake bed). Conversely, the primary attachment structure 42 does not resist detachment when the movement of (or force applied to) the flexible member is in a downward direction toward the bottom of the anchor, and thus may allow release of the flexible member from the primary attachment structure.

The dual attachment assembly 40 may further comprise a secondary attachment structure 50 that forms a frangible attachment of the elongate member to the central shank, and that is only able to be broken or fractured when the primary attachment structure 42 has released the flexible member from the attachment effected by the primary attachment structure. Thus, the frangible nature of the secondary attachment structure 50 only becomes a factor when the primary attachment structure 42 has been detached, such as by the pulling on the flexible member in a particular direction.

In some embodiments, including the illustrative embodiments of the drawings, the secondary attachment structure 50 may comprise a loop 52 formed of a frangible material so as to have a frangible or breakable character. The loop 52 may extend about a portion of the elongate flexible member 28 and may extend about a portion of the central shank 18 of the anchor to thereby attach the flexible member to the shank. Illustratively, in embodiments in which the flexible member comprises a chain of links, the loop 52 may extend through one of the links 54 of the chain. Suitably, although not necessarily, the link 54 through which the loop extends is closely adjacent to the link 48 that is hooked on the finger 46 of the hook element 44. The frangible or breakable material of the loop 52 may comprise a material that has a limited degree of tensile strength such that the application of a sufficient amount of tensile force, such as applied to the loop by pulling on the link 54, fractures the loop and breaks continuity of the loop.

When the elongate flexible member 28 is released from attachment by the primary attachment structure 42, the secondary attachment structure becomes the sole structure attaching the portion of the flexible member 28 to the central shank, and thus bears all of the force that might be applied to the flexible member. If the force applied to the flexible member 28 is sufficient, such as when the anchor is immovably lodged in so underwater obstruction, then the pulling on the securing end of the flexible member by the watercraft may be sufficient to fracture and break the loop. Once the loop of the secondary attachment structure 50 has been broken, the only remaining attachment of the flexible member to the anchor is the relatively permanent attachment of the base end of the flexible member to the bottom end of the central shank 18, so that further pulling applied to the flexible member is applied to the bottom of the anchor rather than the top of the anchor. Removal of all attachment of the flexible member to the top end of the shank changes or shifts the point at which the upward lifting force of the flexible member is applied to the anchor, and tends to invert or turn over the anchor which, in many if not most cases, will allow the anchor to be released from the underwater obstruction.

The combination of the primary attachment structure 42, which is a stronger attachment but only in limited directions of applied force, and the secondary attachment structure 50, which is a weaker attachment but only comes into play when the primary attachment structure has been released, allows for the potential use of a weaker frangible element than could otherwise be used if the frangible element was the sole attachment means. This duality of the attachment structure 40 permits the use of a commonly available device, which is well known and variously referred to as a cable tie, a wire tie, a zip tie, tie wrap, among other things, to form the frangible loop. These ties are often formed of a nylon material, although other materials may be used, and the tongue of the tie may have a cross sectional dimension that does not exceed ¼ inch, although other sizes may be used depending upon the degree of breakage resistance that is desired.

Thus, in normal use of the anchor, when the securing end of the flexible member is pulled in a direction toward the top of the anchor, which occurs when the anchor is being raised, the primary attachment structure as well as the secondary attachment structure act to secure the portion of the flexible member to the top end of the shank, and the anchor is raised in an upright orientation. However, when the securing end of the flexible member is pulled towards the bottom of the anchor, such as would likely occur when the anchor has become lodged in an obstruction on the lake bed or sea floor, the flexible member is released from the hook element, and only the breakable loop holds the flexible member to the shank at the location towards the upper end. This relationship permits the pulling on the securing end of the flexible member to, if applied with a sufficient amount of force, break the loop and the anchor is inverted to be pulled free of the obstruction. Once the anchor is retrieved, the user may reattach the flexible member to the anchor with the primary attachment structure, such as by hooking the chain link 48 on the finger 46, and the user may then reform the secondary attachment structure by looping an unbroken tie about or through the flexible member and about the central shank.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A retrievable anchor system comprising:

an anchor having a top and a bottom, the anchor comprising an elongated central shank having a top end and a bottom end;

an elongate flexible member for suspending the anchor from a boat, the flexible member having a base end and a securing end, the base end being substantially permanently fixed to the bottom end of the central shank of the anchor;

a dual attachment assembly releasably attaching a location on the flexible member to a location on the central shank located toward the top of the anchor, the location on the flexible member being separated from the base end of the flexible member, the dual attachment assembly comprising:

a primary attachment structure forming a directional attachment between the flexible member and the central shank; and a secondary attachment structure forming a frangible attachment of the flexible member to the central shank;

wherein the primary attachment structure comprises a hook element mounted on the central shank towards the top end and configured to engage a portion of the flexible member;

wherein the hook element opens in a direction toward the bottom end of the central shank to allow the flexible member to be released from the hook element when the flexible member is pulled toward the bottom end.

2. The system of claim 1 wherein the secondary attachment structure comprises a loop of frangible material extending about a portion of the elongate flexible member.

3. The system of claim 1 wherein the elongate member comprises a chain formed of links linked together; and wherein the loop extending through one of the links of the chain.

4. The system of claim 1 wherein the primary attachment structure is configured to maintain attachment of the flexible member to the central shank when the flexible member is pulled in an upward direction with respect to the central shank; and wherein the primary attachment structure is configured to release attachment of the flexible member to the central shank when the flexible member is pulled in a downward direction with respect to the central shank.

5. The system of claim 1 wherein the anchor additionally comprises a plurality of fluke elements mounted on the central shank and extending outwardly from the central shank.

6. A dual attachment assembly for an anchor having an elongated central shank with a top end and a bottom end and a chain with a base end substantially permanently fixed to the bottom end of the central shank, the assembly comprising:

a primary attachment structure forming a directional attachment between the chain and the central shank at a first location on the central shank located toward the top of the anchor and at a first location on the chain separated from the base end of the chain, the primary attachment structure being configured to maintain attachment of the location on the chain to the central shank when the chain is pulled in an upward direction with respect to the central shank, the primary attachment structure being configured to release attachment of the location on the chain to the central shank when the chain is pulled in a downward direction with respect to the central shank; and a secondary attachment structure forming a frangible attachment of the chain to the central shank adjacent at a second location on the central shank located toward the top of the anchor and at a second location on the chain separated from the base end of the chain, the secondary attachment structure comprising a loop of frangible material extending about a portion of the chain and about the central shank of the anchor.

7. The assembly of claim 6 wherein the primary and secondary attachment structures are configured such that the first location on the central shank is adjacent to the second location on the central shank and the first location on the chain is adjacent to the second location on the chain.

8. The system of claim 6 wherein the loop extends about the central shank of the anchor.

9. The system of claim 6 wherein the frangible material of the loop comprises a material having a limited degree of tensile strength such that the application of a sufficient amount of tensile force fractures the loop and breaks continuity of the loop.

10. The system of claim 6 wherein the primary attachment structure comprises a hook element mounted on the central shank towards the top end and configured to engage a portion of the flexible member.

11. The system of claim 10 wherein the elongate member comprises a chain formed of links linked together, and wherein the hook element is configured to insert into one of the links of the chain.

12. A retrievable anchor system comprising:

an anchor having a top and a bottom, the anchor comprising an elongated central shank having a top end and a bottom end;

an elongate flexible member for suspending the anchor from a boat, the flexible member having a base end and a securing end, the base end being substantially permanently fixed to the bottom end of the central shank of the anchor;

a dual attachment assembly releasably attaching a location on the flexible member to a location on the central shank located toward the top of the anchor, the location on the flexible member being separated from the base end of the flexible member, the dual attachment assembly comprising:

a primary attachment structure forming a directional attachment between the flexible member and the central shank; and a secondary attachment structure forming a frangible attachment of the flexible member to the central shank;

wherein the primary attachment structure comprises a hook element mounted on the central shank towards the top end and configured to engage a portion of the flexible member;

wherein the hook element is formed by a finger attached to the central shank and extending downwardly and outwardly from the central shank.

13. The system of claim 12 wherein the secondary attachment structure comprises a loop of frangible material extending about a portion of the elongate flexible member.

14. A retrievable anchor system comprising:

an anchor having a top and a bottom, the anchor comprising an elongated central shank having a top end and a bottom end;

a chain for suspending the anchor from a boat, the chain having a base end and a securing end, the base end being substantially permanently fixed to the bottom end of the central shank of the anchor;

a dual attachment assembly releasably attaching a location on the chain to a location on the central shank located toward the top of the anchor, the location on the chain being separated from the base end of the chain, the dual attachment assembly comprising:

a primary attachment structure forming a directional attachment between the chain and the central shank, the primary attachment structure being configured to maintain attachment of the chain to the central shank when the chain is pulled in an upward direction with respect to the central shank, the primary attachment structure being configured to release attachment of the chain to the central shank when the chain is pulled in a downward direction with respect to the central shank; and a secondary attachment structure forming a frangible attachment of the chain to the central shank, the secondary attachment structure comprising a loop of frangible material extending about a portion of the chain and about the central shank of the anchor;

wherein the primary attachment structure comprises a hook element mounted on the central shank towards the top end and configured to engage a portion of the chain; and wherein the hook element opens in a direction toward the bottom end of the central shank to allow the chain to be released from the hook element when the chain is pulled toward the bottom end.

15. The system of claim 14 wherein the frangible material of the loop comprises a material having a limited degree of tensile strength such that the application of a sufficient amount of tensile force fractures the loop and breaks continuity of the loop.

16. The system of claim 14 wherein the loop of the secondary attachment structure extends through a link of the chain.

17. The system of claim 14 wherein the hook element is configured to insert into a link of the chain.

18. The system of claim 14 wherein the hook element is formed by a finger attached to the central shank and extending downwardly and outwardly from the central shank.

* * * * *